US007287599B2

(12) United States Patent
Murray

(10) Patent No.: US 7,287,599 B2
(45) Date of Patent: Oct. 30, 2007

(54) CASING PACKOFF SYSTEM

(75) Inventor: James W. Murray, Palm Desert, CA (US)

(73) Assignee: Directional Systems, Inc., Palm Desert, CA (US)

( * ) Notice: Subject to any disclaimer, the term of this patent is extended or adjusted under 35 U.S.C. 154(b) by 119 days.

(21) Appl. No.: 11/069,264

(22) Filed: Mar. 1, 2005

(65) Prior Publication Data

US 2006/0196680 A1 Sep. 7, 2006

(51) Int. Cl.
*E21B 33/128* (2006.01)

(52) U.S. Cl. ..... 166/387; 166/196

(58) Field of Classification Search ..... 166/387, 166/120, 134, 179, 118, 196
See application file for complete search history.

(56) References Cited

U.S. PATENT DOCUMENTS 5,542,473 A * 8/1996 Pringle ..... 166/120
5,857,520 A * 1/1999 Mullen et al. ..... 166/196
6,019,175 A * 2/2000 Haynes ..... 166/382
6,481,496 B1 * 11/2002 Jackson et al. ..... 166/120
6,691,788 B1 * 2/2004 Dearing ..... 166/382
2002/0070034 A1 * 6/2002 Whitsitt ..... 166/387
2004/0026092 A1 * 2/2004 Divis et al. ..... 166/387
2004/0216868 A1 * 11/2004 Owen ..... 166/134
2005/0211446 A1 * 9/2005 Ricalton et al. ..... 166/382

* cited by examiner

*Primary Examiner*—David Bagnell
*Assistant Examiner*—Daniel P Stephenson
(74) *Attorney, Agent, or Firm*—Christie, Parker & Hale, LLP.

(57) ABSTRACT

A well casing packer is provided that includes a seal mandrel having a first coupler, a second coupler, and a neck extending between the first coupler and the second coupler. A first compression body is slidably coupled to the seal mandrel at the first coupler. A second compression body is connected to the seal mandrel, and a compression lock ring connected to the first compression body. A packer seal is disposed in surrounding relation to a portion of the neck of the seal mandrel and between the second compression body and the compression lock ring, such that a longitudinal movement of the seal mandrel with respect to the first compression body allows the second compression body and the compression lock ring to longitudinally compress and radially expand the packer seal.

9 Claims, 4 Drawing Sheets

212
125
216
236
244
224
215
237
218
217
217
B
214
B
240
238
214
200
242

230
206
232
234
201
204
204
A
219
A
225
202
210

222
208
211'
211
227
226
220

CASING PACKOFF SYSTEM

BACKGROUND OF THE INVENTION

This invention pertains generally to well workover systems and more specifically to casing packoff systems used during a well workover process.

Most oil wells are constructed of an outer casing through which production tubulars are passed. The casing maintains the integrity of the well by preventing the formation material through which the well passes from entering the well bore of the well. Over time, the casing may develop perforations because of the effects of corrosion or mechanical damage caused by tripping tubulars and downhole tools through the casing. These openings may allow undesirable formation fluids to enter the well bore. More importantly, these perforations may allow desirable fluids, such as production fluids from lower formations or drilling fluids, to leak from the casing into a formation, thus causing a loss of these desirable fluids.

Once a casing has developed such leaks, an operator has very few options to remediate the well. One option includes injecting cement into the perforations, termed a "squeeze job", in hopes that the cement will fill the perforations and stop the casing from leaking. Sometimes during a squeeze job the cement migrates to producing zones and the well must be re-perforated in the desired producing zones before it can be used again. Another option is to re-case the well using a smaller diameter casing. As these options are expensive, the well may simply be abandoned if it is a marginal producer. Therefore, a need exists for an inexpensive packoff system for well casing.

Another instance where a packoff system for a casing may be desirable is when an operator wishes to take an existing producing well and enhance its production by drilling into deeper zones or by drilling additional lateral well bores radiating from the well. During the drilling process, the operator may need to temporarily seal off a currently producing zone in the well. In this case, both squeeze jobs and re-casing of the producing zone are too permanent as these solutions will require additional reworking of the well in the currently producing zone to bring the well back into production. Therefore a need exists for a removable casing packer or a casing packer that is so inexpensive that it can be sacrificed during removal.

SUMMARY OF THE INVENTION

In one embodiment, the present invention is a well casing packer that includes a seal mandrel having a first coupler, a second coupler, and a neck extending between the first coupler and the second coupler. A first compression body is slidably coupled to the seal mandrel at the first coupler. A second compression body is connected to the seal mandrel, and a compression lock ring connected to the first compression body. A packer seal is disposed in surrounding relation to a portion of the neck of the seal mandrel and between the second compression body and the compression lock ring, such that a longitudinal movement of the seal mandrel with respect to the first compression body allows the second compression body and the compression lock ring to longitudinally compress and radially expand the packer seal.

In another embodiment, the present invention is a method of isolating a portion of a well having a well casing, wherein the method includes passing a conductor through the well casing; supporting a first end of the conductor by a hanger seal, the hanger seal forming a first fluidic seal between the conductor and the well casing; and supporting a second end of the conductor by an anchor. The method further includes providing a bottom packer coupled to the conductor between the hanger seal and the anchor. The bottom packer forms a second fluidic seal between the conductor and the well casing whereby the portion of the well casing between the hanger seal and bottom packer is isolated from a confined vertical passage through the conductor.

In yet another embodiment, the present invention is a well casing packer that includes a packer seal for forming a fluidic seal between an interior surface of a well casing and an exterior surface of a conductor extending through the well casing. The packer further includes an apparatus for longitudinally compressing and radially expanding the packer seal that includes a mandrel for holding the packer seal; a first compressor for slidably coupling to the mandrel at a first end thereof; and a second compressor for coupling to the mandrel at a second end thereof and for compressing the packer seal between the first compressor and the second compressor.

BRIEF DESCRIPTION OF THE DRAWINGS

These and other features, aspects, and advantages of the present invention will be more fully understood when considered with respect to the following detailed description, appended claims, and accompanying drawings, wherein:

DETAILED DESCRIPTION OF THE INVENTION

Figure 1:
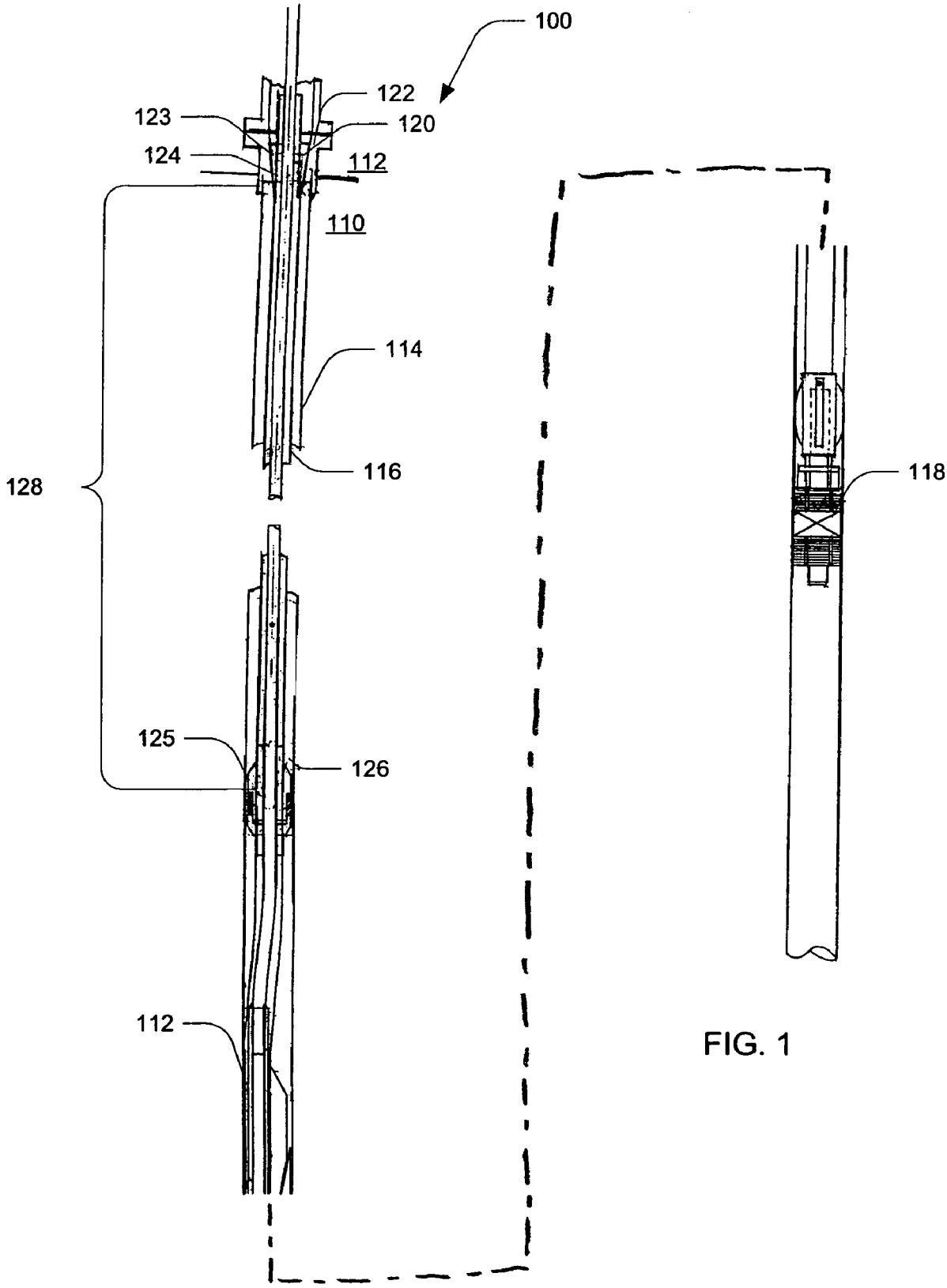
FIG. 1 is a semi-diagrammatic view of a well, well casing, a casing packoff system, and a bottom anchor in accordance with an exemplary embodiment of the present invention.

FIG. 1 is an exploded semi-diagrammatic view of a well, well casing, a casing packoff system, and a bottom anchor in accordance with an exemplary embodiment of the present invention. A well 110 extends downwardly from the surface of the earth 112 to a zone deep within the earth from which oil, gas or another fluid is to be produced. The well is lined along its vertical extent by a conventional well casing 114. The well may be one in which the well casing has deteriorated or one in which an operator wishes to enhance production by performing additional drilling operations as previously described.

The equipment utilized to rework the well includes an elongated vertical string of pipe or conductor 116 which has an external diameter less than the internal diameter of the casing of the well. The conductor is formed in a conventional manner of a series of pipe sections threadedly connected together, and is of a length to extend downwardly from the surface of the earth to the bottom of the well. This conductor thus provides a confined vertical passage downwardly into the well through which drilling operations may be performed or fluids produced.

At a first or lower end, the conductor carries an anchor 118 which may be of conventional construction, and is adapted to engage and grip the casing at the bottom of the well, and form a seal therewith. The anchor may be expanded against the casing when it reaches a desired point in the well, with the expansion being effected by predetermined motion of the conductor, such as by upward movement or turning movement of the conductor.

After a predetermined weight used to compress the bottom seal has been established by an operator at the surface of the well, the weight is set, measurements are taken, and appropriate adjustments are made in the length of the conductor so that a conductor hanger seal 120 at a second or upper end of the conductor will position itself at a specified position in a conventional conductor hanger head 122. The conductor seal hanger thus serves as a hanger for the conductor within the casing.

The conductor hanger seal also provides a fluidic seal between an exterior surface 123 of the conductor and an interior surface 124 of the conductor hanger thus defining a first or top sealed end between the exterior surface of the conductor and the conductor hanger. A bottom packer 125 is located between the first sealed end and the anchor. The bottom packer forms a fluidic seal against an inner surface 126 of the well casing and the outer surface of the conductor. The bottom packer is placed such that it defines a second or bottom sealed end of a now isolated well casing portion 128.

Figures 2, 3, 4:
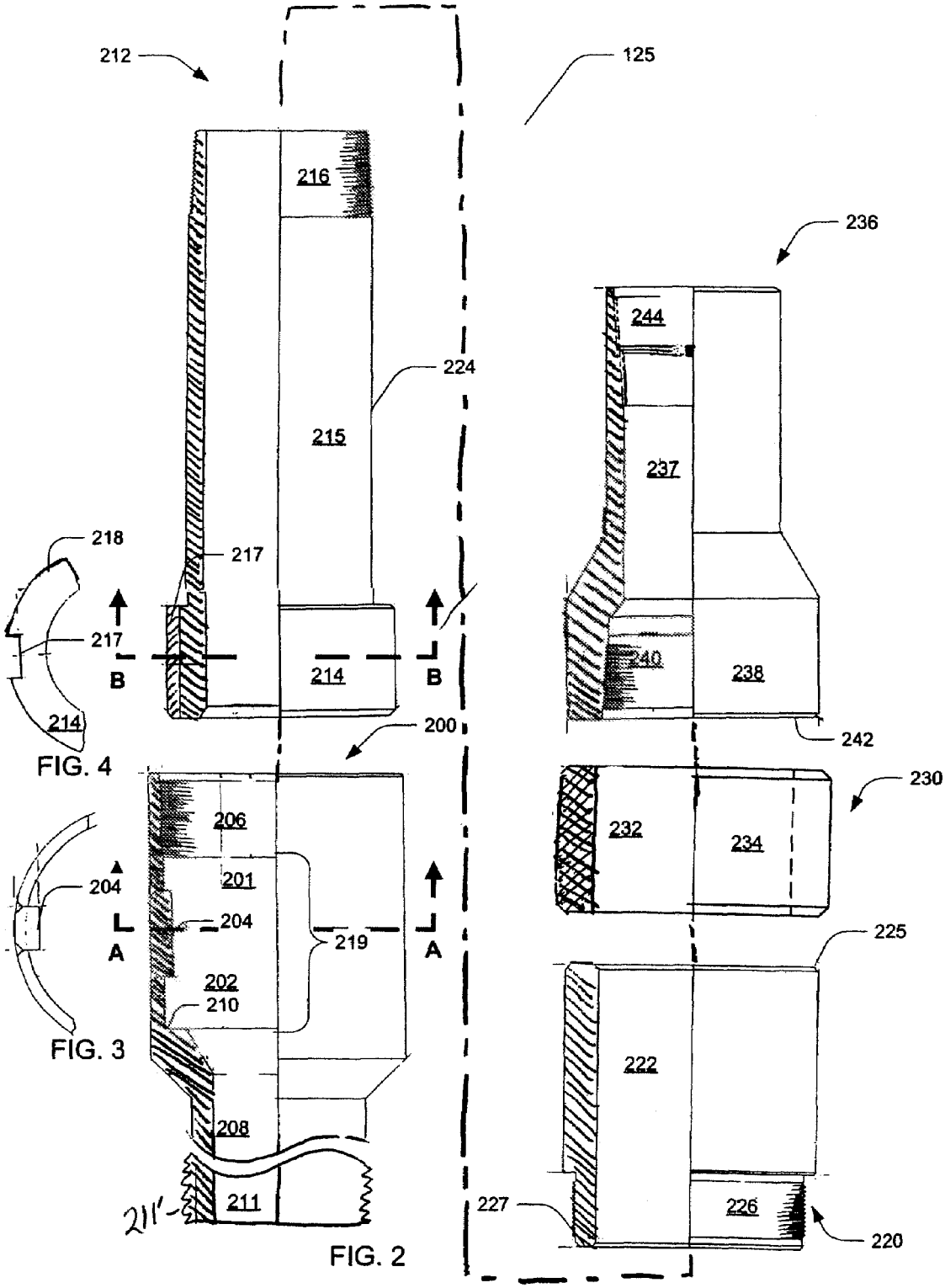
FIG. 2 is an exploded elongated view, partially cut away to show a vertical cross-sectioned view, of a casing packoff system in accordance with an exemplary embodiment of the present invention.
FIG. 3 is a fragmentary portion of a horizontal cross-section taken along the section line A-A of FIG. 2.
FIG. 4 is a fragmentary portion of a horizontal cross-section taken along the section line B-B of FIG. 2.

FIG. 2 is an exploded view of a casing packer used as a bottom packer in accordance with an exemplary embodiment of the present invention. FIG. 3 is a partial horizontal cross-sectional view along the section line A-A of FIG. 2. FIG. 4 is a partial horizontal cross-sectional view along the section B-B of FIG. 2.

Referring now principally to FIG. 2 but also to FIG. 3 and FIG. 4, a casing packer 125 includes a first or lower compression body 200. The lower compression body includes a stepped longitudinally extending bore 201 having a first bore section 202 and a second bore section 208. As the diameter of the first bore section 202 is larger than the diameter of the second bore section 208, the first bore section is separated from the second bore section by a transverse annular shoulder 210. A longitudinally extending key 204 protrudes into the interior of the first bore section 202. The first bore section is terminated at a first end by an internal thread 206. The second bore section may be terminated in a variety of ways depending on the type of conductors used in the casing packoff system. For example, the second bore section 208 may terminate in an internally or externally threaded tubing portion 211 (shown in the illustrated embodiment as having external threads 211') for mating with threaded piping as desired.

The casing packer further includes a cylindrical seal mandrel 212 having a first coupler such as hub 214 at a first end, a neck portion 215 extending to and terminating in a second coupler such as externally threaded portion 216 at a second end. The seal mandrel has a longitudinal bore extending from a first opening at the first end of the seal mandrel to a second opening at the second end of the seal mandrel. The hub 214 of the seal mandrel includes a longitudinal keyway 217 on an outer surface 218 that runs the full length of the hub. The outer diameter of the hub 214 is substantially the same but slightly smaller than the interior diameter of the first bore section 202 of the lower compression body 200 such that the hub of the seal mandrel may be inserted into the first bore section of the lower compression body during makeup. The length of the hub 214 in the longitudinal direction is less than the length of an unthreaded portion 219 of the first bore section 202 of the lower compression body.

The seal mandrel hub 214 is held within the first bore section 202 of the lower compression body by a compression lock ring 220. The compression lock ring includes a longitudinally extending bore 222 through which the neck portion 215 of the seal mandrel may pass; however, the diameter of the compression lock ring's longitudinally extending bore is smaller than the outside diameter of the hub 214, preventing the hub from passing therethrough. The compression lock ring further includes an externally threaded portion 226 that mates with the internally threaded portion 206 of first bore section 202 of the lower compression body. In one embodiment, the compression lock ring 220 forms a hard threaded connection with the first bore section 202 of the lower compression body 200.

During makeup, the hub portion of the seal mandrel is inserted into the first bore section of the lower compression body such that longitudinal keyway 217 of the hub mates with longitudinal key 204 of the first bore section. This prevents rotational displacement between the lower compression body and the seal mandrel. The compression lock ring is then placed over the neck portion of the seal mandrel and threadably coupled to the internally threaded portion of the first bore section of the lower compression body. When the threads of the compression lock ring are fully seated, the hub portion of the seal mandrel is captured in the unthreaded portion 219 of the first bore section of the lower compression body. That is, the hub portion of the seal mandrel is captured between the shoulder 210 of the lower compression body and a lower lip 227 of the compression lock ring 220.

The mated longitudinal key 204 and keyway 217 prevent rotational movement of the seal mandrel with respect to the lower compression body. However, as the length of the hub of the seal mandrel is less than the length of the unthreaded portion 219 of the first bore section of the lower compression body, the seal mandrel is allowed to move longitudinally with respect to the lower compression body.

A packer seal 230 made of a resilient material includes a longitudinally extending bore 232 passing entirely through the packer seal. The diameter of the bore is approximately equal to the outer diameter 224 of the neck portion 215 of the seal mandrel such that the packer seal may be placed onto the seal mandrel by inserting the neck portion of the seal mandrel into the packer seal. During makeup, the packer seal is placed over the seal mandrel until it rests against an upper lip 225 of the compression lock ring.

A cylindrical second or upper compression body 236 includes a longitudinally extending bore terminating in a head 238 at a first opening. The head has an internally threaded portion 240 that mates with the threads of the externally threaded portion 216 of seal mandrel 212. In one embodiment, the upper compression body 236 forms a hard threaded connection with the externally threaded portion 216 of seal mandrel 212.

Once made up, the packer seal 230 is captured between the upper lip 225 of the compression lock ring and a lower lip 242 of the upper compression body. In order for the packer seal 230 to form a fluid tight seal between the conductor 116 and the well casing 126 (of FIG. 1), the conductor 116 is moved downwardly, causing the seal mandrel 212 (and hence the upper compression body 236, which is threaded to the seal mandrel 212) to be moved downwardly or longitudinally with respect to the lower compression body 200 (and hence the compression lock ring 220, which is threaded to the lower compression body 200). This movement causes the packer seal 230 to be longitudinally compressed by the weight of the conductor 116 between the upper lip 225 of the compression lock ring 220 and the lower lip 242 of the upper compression body 236. The longitudinal compression of the packer seal 230 causes a corresponding radially expansion of the diameter of the packer seal 230, allowing the packer seal 230 to form a fluid tight seal against an internal surface of well casing 126 (of FIG. 1). In order to release the packer seal 230, the conductor 116 is moved upwardly to release the weight of the conductor from the packer seal 230.

As is also shown in FIG. 2, the longitudinally extending bore of the upper compression body further terminates at a second opening having an internally threaded portion 244 that may be used to form a threaded connection to a piping or conductor section.

It should be noted that although the names given herein to the lower compression body 200, the compression lock ring 220 and the upper compression body 236 each contain the term "compression," this term is used primarily to describe the use of these elements to compress the packer seal 230, and does not signify that these elements are themselves compressible.

Figure 5:
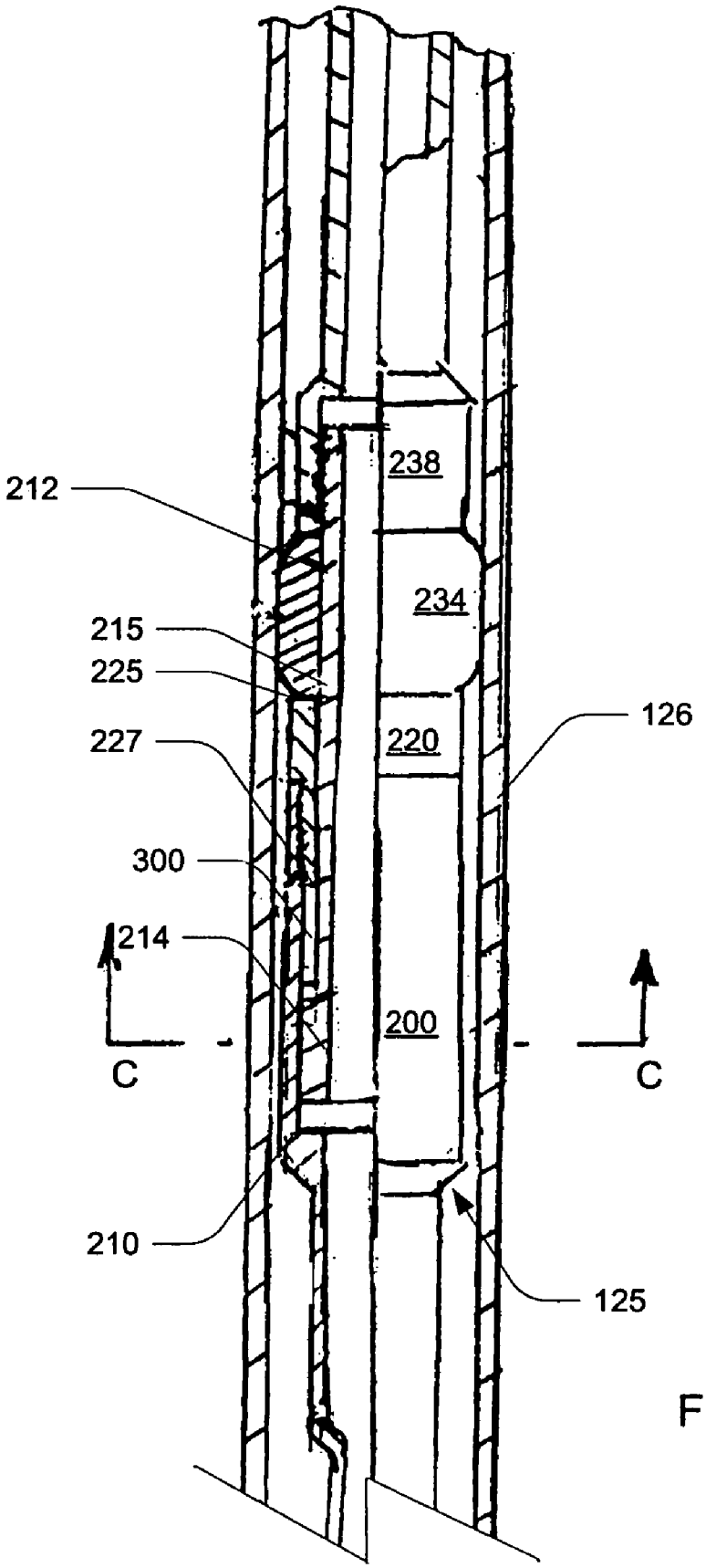
FIG. 5 is a semi-diagrammatic vertical cross-sectional view of a completed casing packoff system in accordance with an exemplary embodiment of the present invention.

FIG. 5 is a semi-diagrammatic cross-sectional view of an assembled casing packer in accordance with an exemplary embodiment of the present invention. The casing packer 125 includes the lower compression body 200 which receives the hub of the seal mandrel 212. The neck portion 215 of the seal mandrel is inserted through the compression lock ring 220 threadably coupled to the lower compression body. The compression lock ring captures the hub in the first bore section 202 of the lower compression body.

The longitudinally extending key 204 (of FIG. 2) protrudes into the interior of the first bore section and mates with the longitudinally extending keyway 217 (of FIG. 2). Once the compression lock ring is in place, the hub of the seal mandrel is captured between the lower lip 227 of the compression lock ring and the shoulder 210 at the first (lower) end of the first bore section. Because the hub 214 is shorter than the portion of the first bore section 202 which is not occluded by the compression lock ring 220, the hub is free to move longitudinally in relation to the lower compression body within an annular space 300 between the lower lip of the compression ring and the shoulder terminating the first bore section. However, the hub is prevented from rotating in relation to the lower compression body by the mated key 204 and keyway 217. Thus the seal mandrel is slidably coupled to the lower compression body yet capable of transmitting rotational motion to the lower compression body.

The neck portion 215 of the seal mandrel extends through the packer seal 230 which is made of a resilient material that rests against an upper lip 225 of the compression lock ring. The second cylindrical upper compression body 236 is threadably coupled to the lower seal mandrel, capturing the packer seal between the upper lip of the compression lock ring and the lower lip 242 of the upper compression body. The conductor 116 is moved downwardly to allow the weight of the conductor to longitudinally compress the packer seal between the upper lip of the compression lock ring and the lower lip of the upper compression body, thus radially deforming (expanding) the packer seal outwardly to form a seal against an internal surface of the well casing 126.

Figure 6:
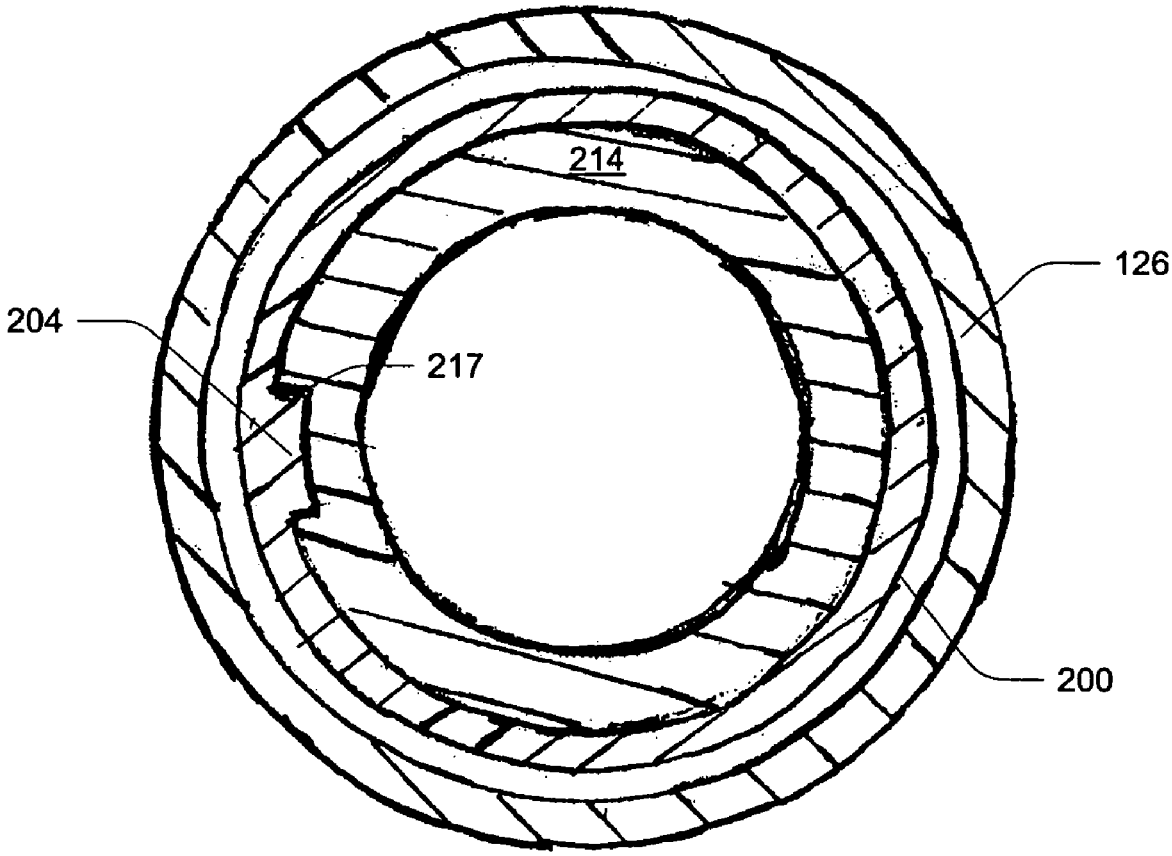
FIG. 6 is a horizontal cross section taken along the section line C-C of FIG. 5.

FIG. 6 is a horizontal cross-sectional view taken along the section line C-C of FIG. 5. Shown in the cross-section is the hub 214 of the seal mandrel 212 (FIG. 2) captured within the first bore section 202 (FIG. 2) of the lower compression body 200. The key 204 of the lower compression body is located within the keyway 217 of the hub.

Although this invention has been described in certain specific embodiments, many additional modifications and variations would be apparent to those skilled in the art. It is therefore to be understood that this invention may be practiced otherwise than as specifically described. Thus, the present embodiments of the invention should be considered in all respects as illustrative and not restrictive, the scope of the invention to be determined by any claims supportable by this application and the claims' equivalents.

What is claimed is:

1. A well casing packer comprising:
- a seal mandrel having a first coupler, a second coupler, and a neck extending between the first coupler and the second coupler;
- a first fixed compression body having the first coupler of the seal mandrel slidably disposed therein to the seal mandrel at the first coupler;
- a second compression body fixedly connected to the second coupler of the seal mandrel;
- a detachable compression lock ring disposed around the neck of the seal mandrel and fixedly connected to the first compression body such that the first coupler of the seal mandrel is slidingly retained within the first compression body;
- a packer seal disposed in surrounding relation to a portion of the neck of the seal mandrel and between the second compression body and the compression lock ring, such that the longitudinal movement of the seal mandrel with respect to the first compression body forces the second compression body to move toward the compression lock ring such that the packer seal is longitudinally compressed and radially expanded to form a seal against the well casing.

2. The well casing packer of claim 1, wherein the seal mandrel comprises a key that slidably couples to a keyway in the first compression body thereby allowing longitudinal movement, while preventing rotational movement between the seal mandrel and the first compression body.

3. The well casing packer of claim 1, wherein the first coupler of the seal mandrel is a hub that is longitudinally moveable within a first bore section of the first compression body between an internal shoulder of the first compression body and a lip of the compression lock ring.

4. The well casing packer of claim 3, wherein the hub comprises a key that slidably couples to a keyway in the first bore section of the first compression body thereby allowing longitudinal movement, while preventing rotational movement between the seal mandrel and the first compression body.

5. A method of isolating a portion of a well having a well casing, comprising:
- passing a conductor through the well casing;
- supporting a first end of the conductor by a hanger seal, the hanger seal forming a first fluidic seal between the conductor and the well casing;
- supporting a second end of the conductor by an anchor;
- providing a bottom packer coupled to the conductor between the hanger seal and the anchor, the bottom packer forming a second fluidic seal between the conductor and the well casing whereby the portion of the well casing between the hanger seal and bottom packer is isolated from a confined vertical passage through the conductor;

wherein providing the bottom packer further comprises:

providing a seal mandrel having a first coupler, a second coupler, and a neck extending between the first coupler and the second coupler;

slidably coupling the seal mandrel at the first coupler to a first compression body;

coupling a second compression body to the second coupler of the seal mandrel;

coupling a compression lock ring to the first compression body;

placing a packer seal in surrounding relation to a portion of the neck of the seal mandrel and between the second compression body and the compression lock ring; and longitudinally displacing the seal mandrel with respect to the first compression body allowing the second compression body and the compression lock ring to longitudinally compress and radially expand the packer seal to form the second fluidic seal between the conductor and the well casing.

6. The method of claim 5, wherein slidably coupling the seal mandrel at the first coupler to the first compression body comprises coupling a key of the seal mandrel to a keyway of the first compression body thereby allowing longitudinal movement, while preventing rotational movement, between the seal mandrel and the first compression body.

7. The method of claim 5, wherein the first coupler of the seal mandrel is a hub that is longitudinally moveable within a first bore section of the first compression body between an internal shoulder of the first compression body and a lip of the compression lock ring.

8. The method of claim 7, wherein the hub comprises a key that slidably couples to a keyway in the first bore section of the first compression body thereby allowing longitudinal movement, while preventing rotational movement, between the seal mandrel and the first compression body.

9. A well casing packer comprising:

a packer seal for forming a fluidic seal between an interior surface of a well casing and an exterior surface of a conductor extending through the well casing;

means for longitudinally compressing and radially expanding the packer seal, comprising:

a mandrel for holding the packer seal;

first compression means for slidably coupling to the mandrel at a first end thereof;

second compression means for coupling to the mandrel at a second end thereof and for compressing the packer seal between the first compression means and the second compression means;

wherein the first coupler of the seal mandrel comprises a hub; and wherein the well casing packer further comprising means for capturing the hub within a first bore section of the first compression means; and wherein the hub comprises keying means for slidably coupling the hub to a corresponding keying means in the first bore section of the first compression means, thereby allowing longitudinal movement while preventing rotational movement between the seal mandrel and the first compression means.

* * * * *